US007607230B2

(12) United States Patent
Aviza et al.

(10) Patent No.: US 7,607,230 B2
(45) Date of Patent: Oct. 27, 2009

(54) BLADE SUBASSEMBLIES FOR SHAVING RAZORS

(75) Inventors: Gregory D. Aviza, Marlborough, MA (US); Robert A. Trotta, Pembroke, MA (US); Charles B. Worrick, Hanson, MA (US)

(73) Assignee: The Gillette Company, Boston, MA (US)

( * ) Notice: Subject to any disclaimer, the term of this patent is extended or adjusted under 35 U.S.C. 154(b) by 0 days.

(21) Appl. No.: 11/881,237

(22) Filed: Jul. 25, 2007

(65) Prior Publication Data

US 2007/0266565 A1 Nov. 22, 2007

Related U.S. Application Data

(62) Division of application No. 10/744,848, filed on Feb. 9, 2004, now Pat. No. 7,272,991.

(51) Int. Cl.
*B26B 21/00* (2006.01)

(52) U.S. Cl. ..... 30/50

(58) Field of Classification Search ..... 30/40, 30/40.2, 50–53, 64–68, 344, 346.51, 346.57, 30/346.59; 76/104.1, DIG. 8; D28/47
See application file for complete search history.

(56) References Cited

U.S. PATENT DOCUMENTS

| | | | | | |
|---|---|---|---|---|---|
| 3,137,940 | A | * | 6/1964 | Curci | 30/40 |
| 4,200,976 | A | | 5/1980 | Gooding | |
| 4,245,389 | A | * | 1/1981 | Trotta | 30/64 |
| 4,246,045 | A | * | 1/1981 | Ulam | 148/531 |
| 4,516,321 | A | | 5/1985 | Francis et al. | |
| 4,932,122 | A | | 6/1990 | Shurland et al. | |
| 4,980,974 | A | * | 1/1991 | Radcliffe | 30/50 |
| 5,237,536 | A | | 8/1993 | Ohtsuki | |
| 5,313,706 | A | | 5/1994 | Motta et al. | |
| 5,369,885 | A | | 12/1994 | Ferraro | |
| 5,402,574 | A | * | 4/1995 | Milner | 30/50 |
| 5,416,974 | A | | 5/1995 | Wain | |
| 5,426,851 | A | * | 6/1995 | Gilder et al. | 30/50 |
| 5,546,660 | A | | 8/1996 | Burout et al. | |
| 5,551,153 | A | | 9/1996 | Simms | |
| 6,009,624 | A | * | 1/2000 | Apprille et al. | 30/50 |
| 6,032,372 | A | | 3/2000 | Dischler | |
| 6,035,537 | A | | 3/2000 | Apprille et al. | |
| 6,145,201 | A | | 11/2000 | Andrews | |
| 6,161,288 | A | | 12/2000 | Andrews | |
| 6,216,345 | B1 | | 4/2001 | Andrews | |
| 6,216,561 | B1 | | 4/2001 | Dischler | |
| 6,397,473 | B1 | | 6/2002 | Clark | |

(Continued)

FOREIGN PATENT DOCUMENTS

| | | | |
|---|---|---|---|
| WO | WO 9411163 | A1 * | 5/1994 |

(Continued)

*Primary Examiner*—Jason Daniel Prone
(74) *Attorney, Agent, or Firm*—John M. Lipchitz; Kevin C. Johnson; Steven W. Miller

(57) ABSTRACT

A subassembly for a shaving razor that includes a plurality of elongated metal blades that are secured to each other as an integral unit. The plural blades have cutting edges defining a shaving surface, and are secured to each other by weld connections at their respective longitudinal ends.

16 Claims, 8 Drawing Sheets

U.S. PATENT DOCUMENTS

| | | | | |
|---|---|---|---|---|
| 6,839,968 | B2 * | 1/2005 | Brown et al. | 30/50 |
| 7,024,776 | B2 | 4/2006 | Wain | |
| 7,131,202 | B2 * | 11/2006 | Pennell et al. | 30/50 |
| 7,272,991 | B2 * | 9/2007 | Aviza et al. | 30/50 |
| 2002/0144404 | A1 * | 10/2002 | Gilder et al. | 30/50 |
| 2003/0208907 | A1 | 11/2003 | Brown et al. | |
| 2004/0255467 | A1 * | 12/2004 | Lembke et al. | 30/50 |
| 2005/0172489 | A1 * | 8/2005 | Aviza | 30/32 |
| 2006/0101647 | A1 * | 5/2006 | Gilder et al. | 30/50 |
| 2006/0248726 | A1 * | 11/2006 | Coffin | 30/50 |
| 2007/0011880 | A1 * | 1/2007 | Pennell et al. | 30/50 |
| 2007/0028450 | A1 * | 2/2007 | Pennell et al. | 30/50 |
| 2007/0256303 | A1 * | 11/2007 | Lembke et al. | 30/50 |
| 2008/0066315 | A1 * | 3/2008 | Xu | 30/50 |
| 2009/0113716 | A1 * | 5/2009 | Wain et al. | 30/50 |

FOREIGN PATENT DOCUMENTS

| | | |
|---|---|---|
| WO | WO 9504637 A1 * | 2/1995 |
| WO | WO 01/39937 | 6/2001 |
| WO | WO 02/32632 | 4/2002 |

* cited by examiner

FIG. 1
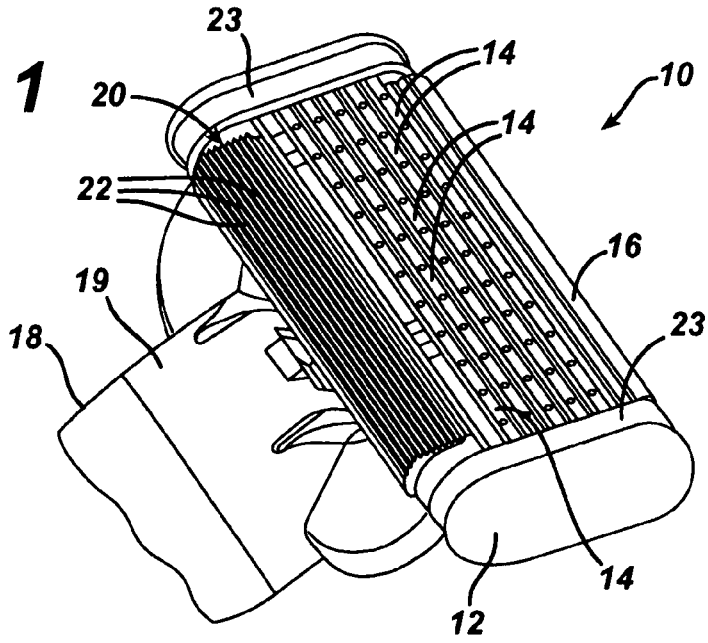
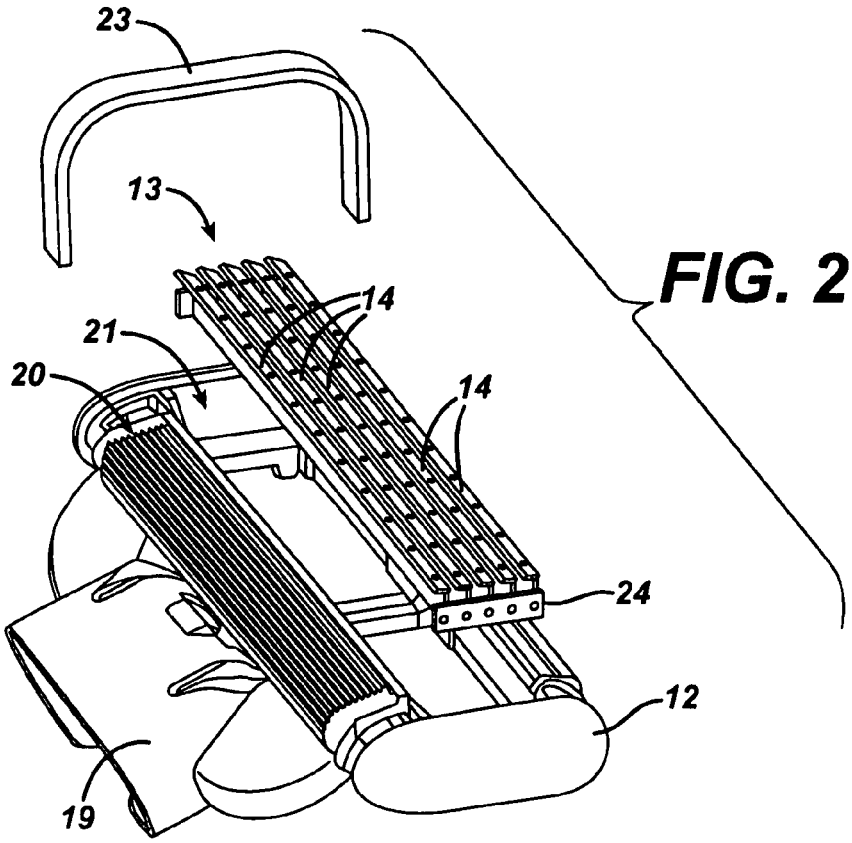
FIG. 2

FIG. 9
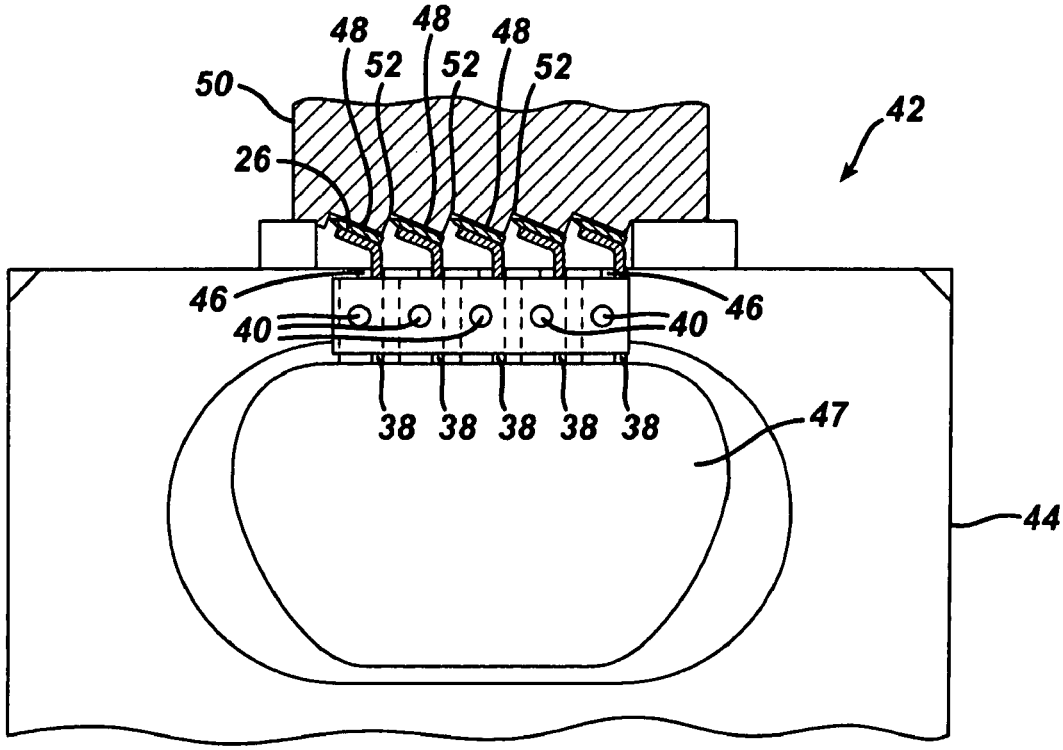
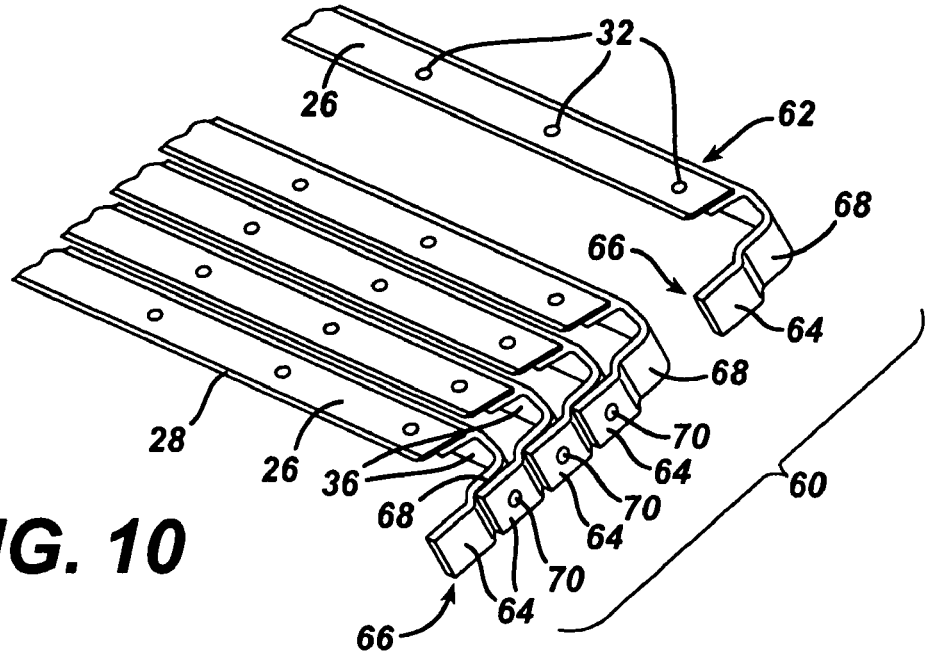
FIG. 10

BLADE SUBASSEMBLIES FOR SHAVING RAZORS

This application is a divisional of U.S. application Ser. No. 10/774,848, filed on Feb. 9, 2004, now U.S. Pat. No. 7,272, 991 B2.

The invention relates to shaving razors, and blade subassemblies therefor and methods of manufacture.

Shaving razors often include a plurality of blades that are secured in a desired position in a plastic housing. The housing is often provided with a guard with fins or other skin engaging structures made of elastomeric material in front of the blades, and a cap on which the skin can slide behind the blades. A shaving aid (e.g., a lubricant agent dispensing mechanism) can be incorporated into the cap and, in some cases, the guard. The blades can be stationary or movable, and the housing can be fixed to a handle or movably mounted on the handle, to, e.g., assist in following the contours of the skin during shaving.

Examples of some different types of shaving razors are described in U.S. Pat. Nos. 5,313,706; 5,369,885; 5,416,974; 5,546,660; 6,032,372; 6,145,201; 6,161,288; 6,216,345; 6,216,561; and 6,397,473.

SUMMARY OF THE INVENTION

In one aspect, the invention features, in general, a subassembly for a shaving razor that includes a plurality of elongated metal blades that are secured to each other as an integral unit. The plural blades have cutting edges defining a shaving surface, and are secured to each other by weld connections at their respective longitudinal ends.

Particular embodiments of the invention may include one or more of the following features. In particular embodiments, the longitudinal ends of the blades are bent and are transverse to the cutting edges. In some embodiments, the unit includes two metal plates, and one set of longitudinal ends are connected by first weld connections to a first metal plate, and the other set of longitudinal ends are connected by second weld connections to a second metal plate. The plates can have a stainless steel base and an aluminum cladding thereover. In some other embodiments, one set of longitudinal ends of the blades overlap and are welded to adjacent ends at one side of the unit, and the other set of longitudinal ends of the blades overlap and are welded to adjacent ends at the other side of the unit. In some embodiments each blade includes an elongated cutting member having a cutting edge and an elongated support to which the elongated cutting member is attached, with the longitudinal ends of the elongated support being welded to each other at the two sides. In some other embodiments, each blade includes an elongated cutting member portion having a cutting edge and an integral elongated support portion bent downward from the cutting member portion, with the longitudinal ends of the elongated support portion being welded to each other at the two sides. In still other embodiments, each blade includes an elongated cutting member having a cutting edge, and the longitudinal ends of the elongated cutting member are welded to each other at the two sides. The subassembly can have two blades, three blades, four blades or five blades or more. The cutting edges can be located in a common plane. The subassembly can have a snap-fitting structure for connection to a housing of a shaving razor.

In another aspect the invention features, in general, a shaving razor including a subassembly as already described, and a housing having a recess in which the subassembly is secured.

In another aspect the invention features, in general, a method of making a shaving razor that includes providing a plurality of elongated metal razor blades having cutting edges and first and second longitudinal ends, positioning the cutting edges parallel to each other and spaced from adjacent cutting edges so as to define a shaving surface, connecting the first longitudinal ends to each other and the second longitudinal ends to each by welding while the cutting edges are maintained parallel to each other.

Particular embodiments of the invention may include one or more of the following features. In particular embodiments a fixture is used to align the blades in parallel planes and to position the cutting edges at desired positions. The fixture has slots to align the blades and stop surfaces to position the cutting edges. The integral unit of blades is positioned into a recess in a housing. The recess can be open to the top, with, e.g., the integral blade unit being lowered into the recess and held in place by clips or by snap-fitting, or the recess can open to the bottom, with the integral blade unit being raised into the recess.

Embodiments of the invention may include one or more of the following advantages. Automated assembly of razor blade cartridges can be simplified by installing all of the blades as a unit in a single step. The geometry of the cutting edges with respect to each other can be set prior to assembly, e.g., with a fixture, and tightly controlled and varied, if desired. The subassembly of blades can be removably mounted in a housing and replaced with a new subassembly as the blades become spent, thereby decreasing the parts that are disposed and reusing more parts. Also, integrated blade unit subassemblies can be manufactured with a variety of different blade geometries, with, e.g., different blade tangent angles, exposures, and/or spans, and the different subassemblies can all be used with a common design for the rest of the cartridge into which they are inserted, simplifying part count and tooling at the same time that a variety of different geometries can be easily implemented.

Other advantages and features of the invention will be apparent from the following description of particular embodiments thereof and from the claims.

BRIEF DESCRIPTION OF THE INVENTION

FIG. 1 is a partial, perspective view of a shaving razor.

FIG. 2 is an exploded, partial, perspective view of the FIG. 1 shaving razor.

FIG. 9 is a diagrammatic side view of fixture used in the manufacture of the FIG. 3 blade subassembly.

FIG. 10 is a diagrammatic, partial, exploded view of an alternative embodiment of a blade subassembly that does not have side plates.

DETAILED DESCRIPTION

Figure 3:
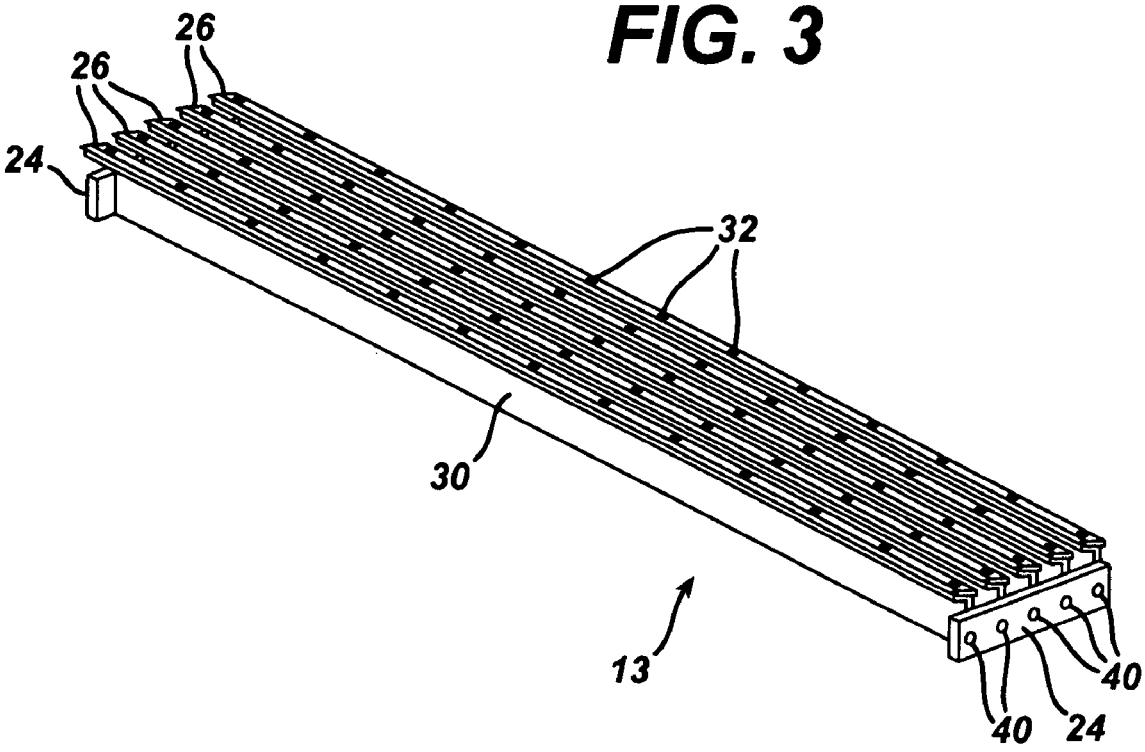
FIG. 3 is a perspective view of a blade subassembly of the FIG. 1 shaving razor.
Figure 6:
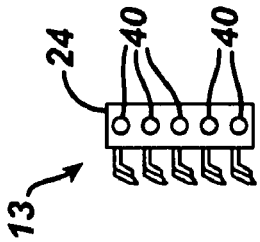
FIG. 6 is a side elevation of the FIG. 3 blade subassembly.
Figure 4:
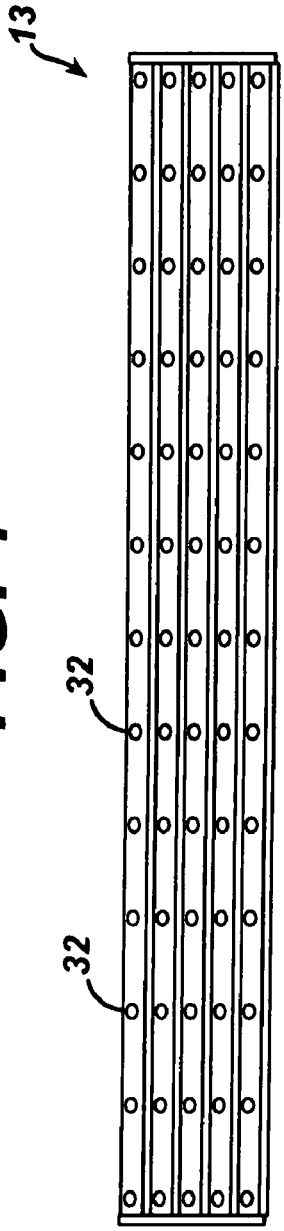
FIG. 4 is a plan view of the FIG. 3 blade subassembly.
Figure 5:
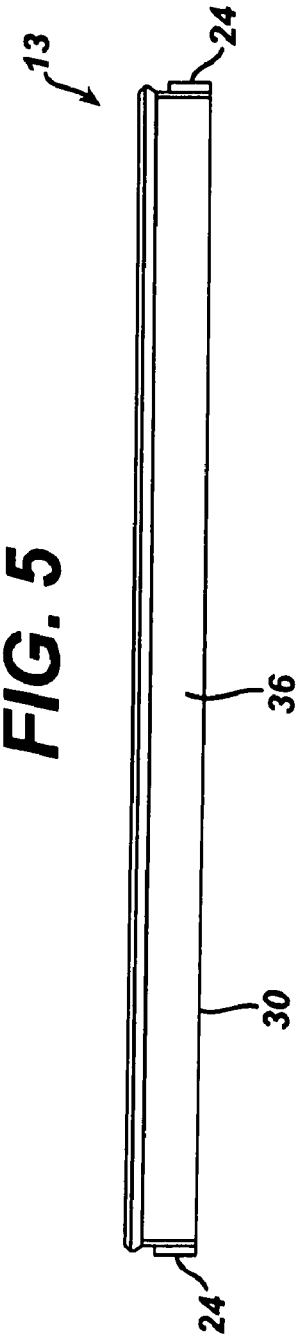
FIG. 5 is a front elevation of the FIG. 3 blade subassembly.
Figure 7:
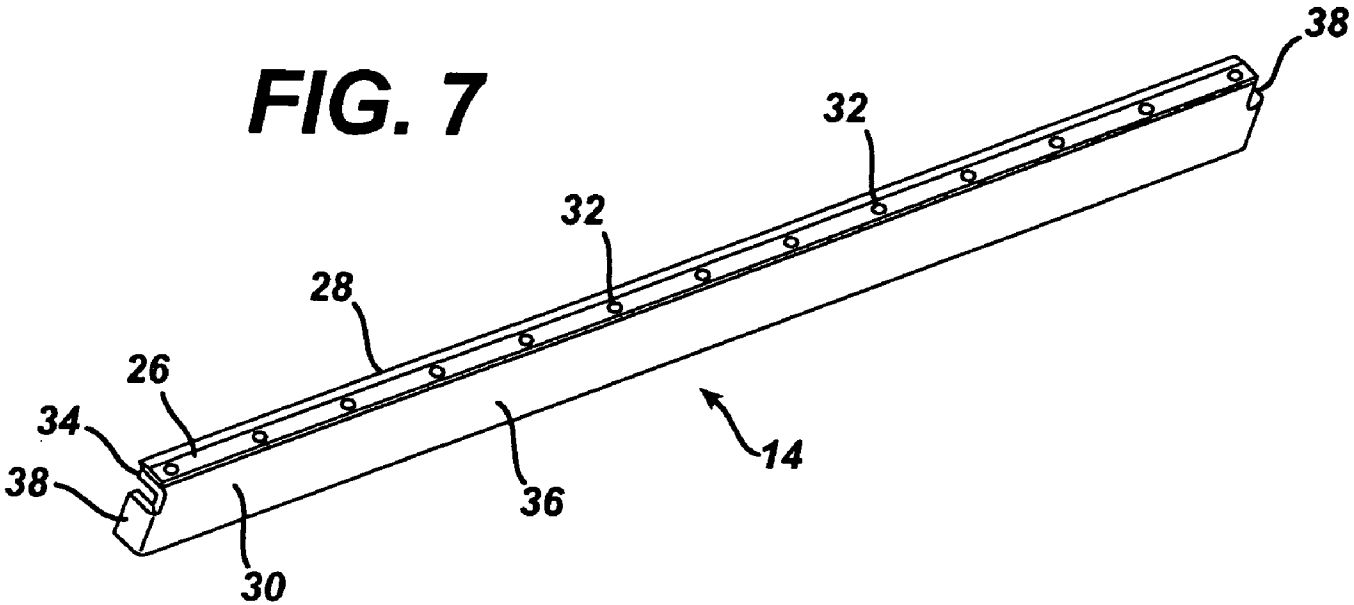
FIG. 7 is a perspective view of a blade of the FIG. 3 blade subassembly.
Figure 8:
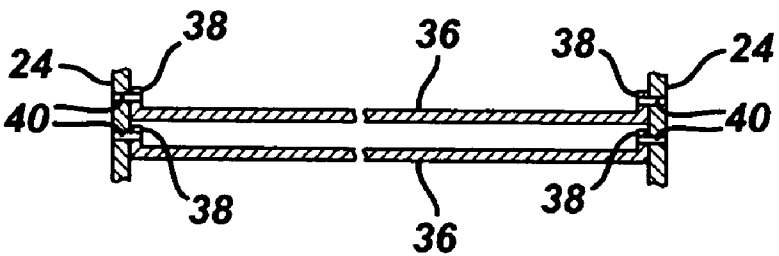
FIG. 8 is a partial diagrammatic plan view illustrating blade and side plate components of the FIG. 3 blade subassembly.

Referring to FIG. 1, shaving razor 10 includes plastic housing 12, blades 14 secured in housing 12, cap 16 (including a lubricating strip), handle 18, connecting piece 19 (which is pivotally connected to housing 12 and removably connected to handle 18), and elastomeric guard 20 which has fins 22. There are five blades 14 having cutting edges 28 (see FIG. 7) that define a shaving surface. As appears from FIG. 2, blades 14 are provided in an integrated blade subassembly 13 that mounts in recess 21 in housing 12 from the top and is held in place by two clips 23, only one of which is shown in FIG. 2.

Referring to FIGS. 3-8, blade subassembly 13 includes five blades 14 and two side plates 24. Plates 24 have a stainless steel base and an aluminum cladding thereover for corrosion resistance. However, corrosion resistance can be achieved by other means and materials, such as by the contact with a separate cartridge component that acts as a sacrificial anode such as an aluminum clip or a separate zinc component.

Each blade 14 includes an elongated cutting member 26 having cutting edge 28 and elongated support 30 to which cutting member 26 is attached by spot welds 32. Elongated support 30 has an angled section along its length, with a short upper portion 34 and longer base portion 36. The longitudinal ends 38 of base portion 36 are bent 90°, and are secured to side plates 24 by spot welds 40.

Figure 12:
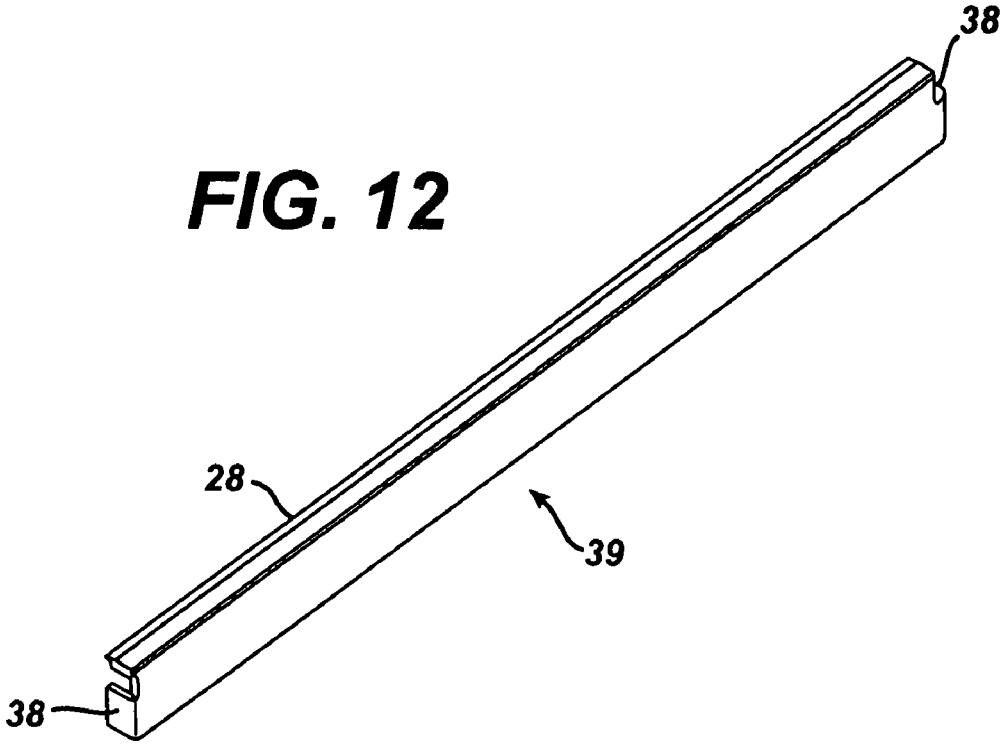
FIGS. 12-13 are perspective views of alternative, one-piece blade constructions.
Figure 13:
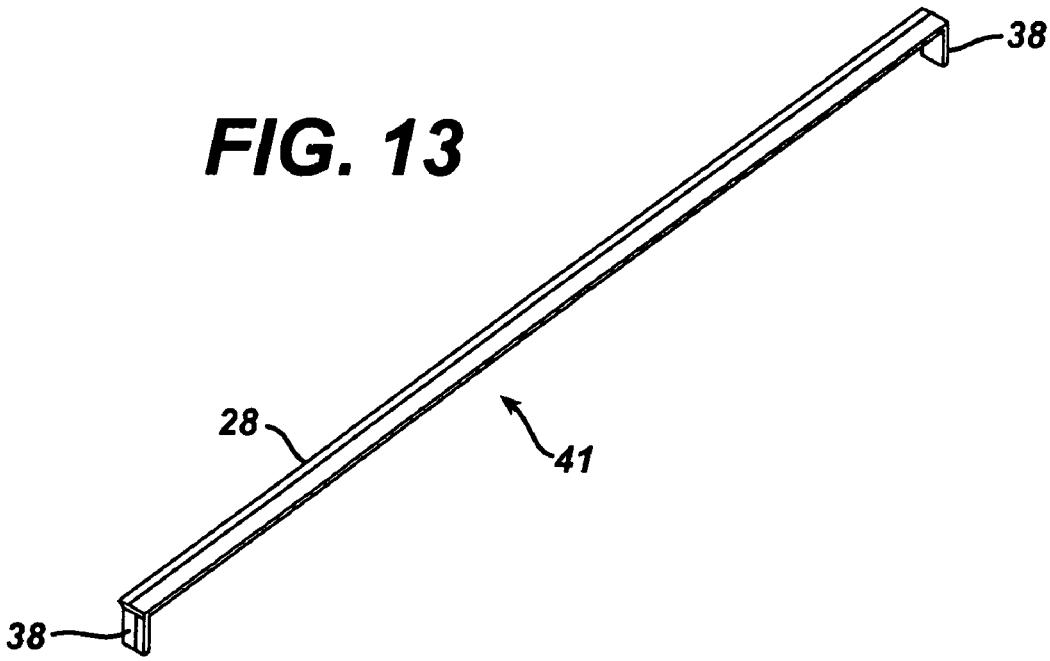

Alternatively, the elongated cutting members could be one-piece constructions having a cutting edge portion and an integral bent base portion, as shown, e.g., for one-piece complex member 39 in FIG. 12, or not even have a bent base portion, as shown, e.g., for one-piece simple cutting member 41 in FIG. 13.

Referring to FIG. 9, fixture 42 is used to position blades 14 while they are welded to side plates 24 by spot welds 40. Fixture 42 has base member 44 that includes slots 46 that receive base portions 36 of elongated supports 30 of blades 14. Bladder 47 provides an upward force to the bottoms of base portions 36, to cause cutting members 26 to abut angled surfaces 48 of alignment block 50, and cutting edges 28 to contact corners 52, thereby placing the cutting edges 28 in the desired position to define a shaving surface, and providing the desired blade tangent angle for cutting members 26. With blades 14 properly positioned in slots 46 and biased upward against surfaces 48 and corners 52, side plates 24 are welded to bent longitudinal ends 38, resulting in an integral blade subassembly 30, that can then be simply inserted into recess 21 and moved into position in housing 12 and secured therein by clips 23 (FIGS. 1, 2). Alternatively, the blades could also be rear mounted into a cartridge housing that has a recess 21 that opens from the bottom. Also, if desired, alignment block 50 can allow for different blades to have different blade tangent angles, exposures and/or spans by different positions for angled surfaces 48 and corners 52 of alignment block 50.

Referring to FIG. 10, alternative blade subassembly 60 (shown prior to attachment of the last blade 62) differs from blade subassembly 30 in that it does not have side plates 24, but instead has offset extensions 64 on the longitudinal ends 66 that overlap and are welded to portions 68 of the prior blade 62 by welds 70.

Figure 11:
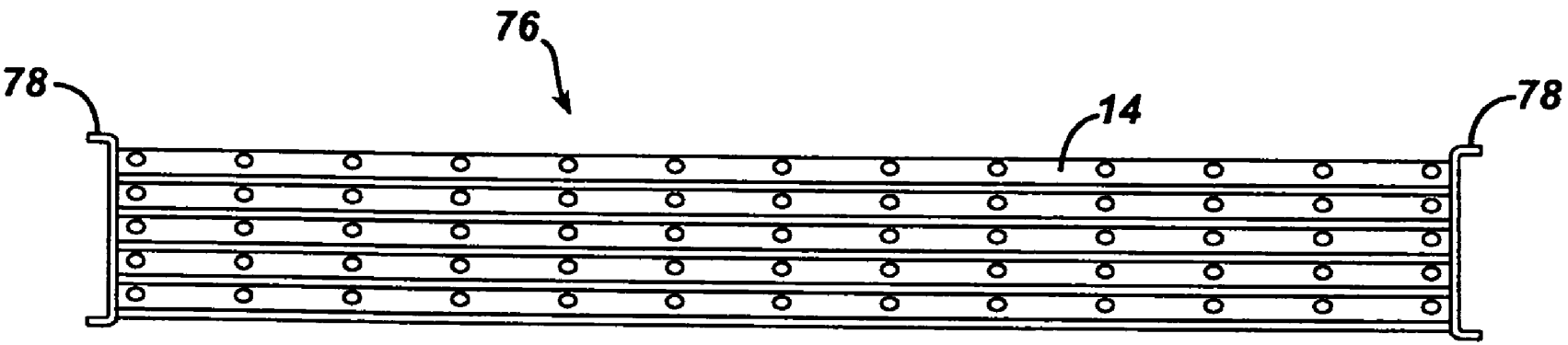
FIG. 11 is an elevation of an alternative embodiment of a blade subassembly that is replaceable.

Referring to FIG. 11, alternative blade subassembly 76 has angled side plates 78 that are snap-fit into housing 12 and held in housing 12 without the need for clips 23. When the blades need to be replaced, instead replacing the entire cartridge (including housing 12 and connecting piece 19 as well as the blades) one pushes the used subassembly 76 out from the bottom, and simply snaps in a new subassembly 76, permitting the housing 12 and connecting piece 19 to be used multiple times. Alternatively, side plates 78 could be slidably mounted in guide slots (not shown) in the housing to allow the blades to be floating, sliding up and down, in the cartridge.

Other embodiments of the invention are within the scope of the appended claims. For example, other techniques (such as elastomeric materials, magnetism, solenoids, and springs) can be used in place of bladder 47 to bias the blades 14 into the proper position. Other structures or shapes can be used in place of angled surfaces 48 and corners 52 to align the blades. Oval spots and dual spots can be used in place of the round spot welds 40 and 70.

Figure 14:
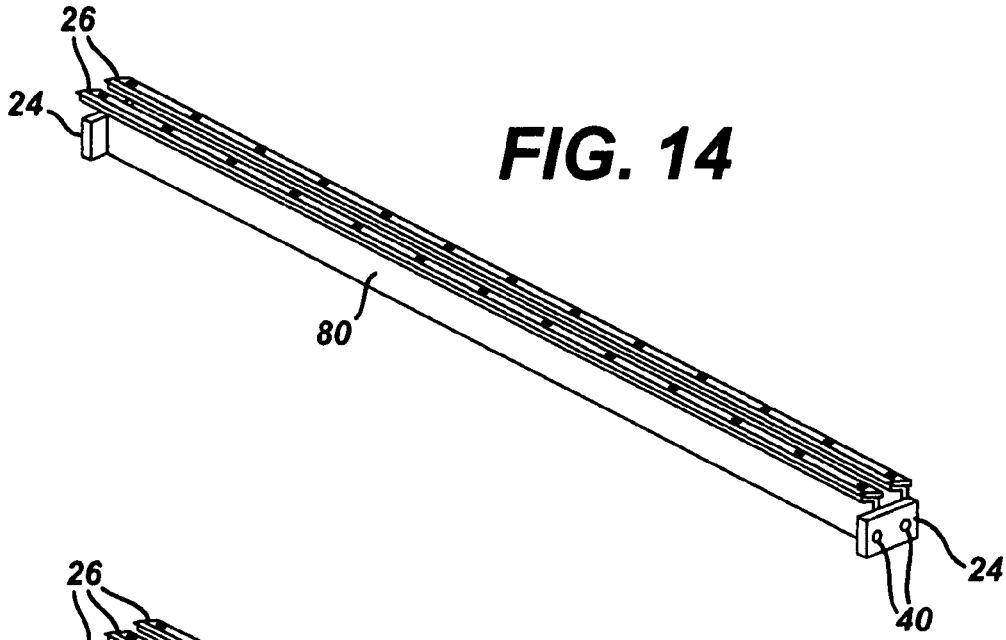
FIGS. 14-16 are a perspective view of two-, three- and four-blade alternative subassemblies, respectively, for use in the FIG. 1 shaving razor.
Figure 15:
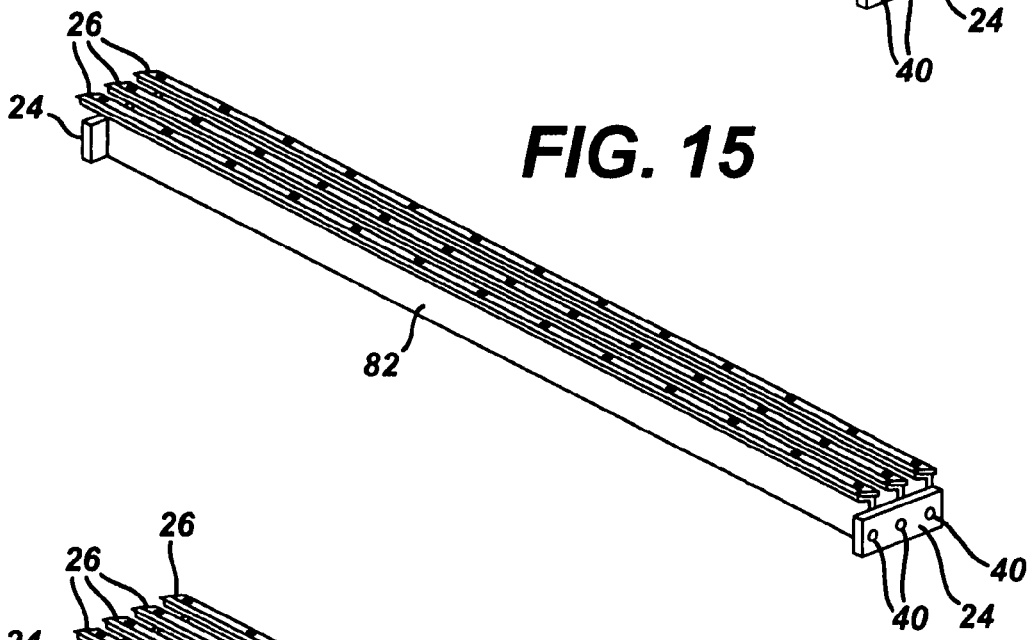
Figure 16:
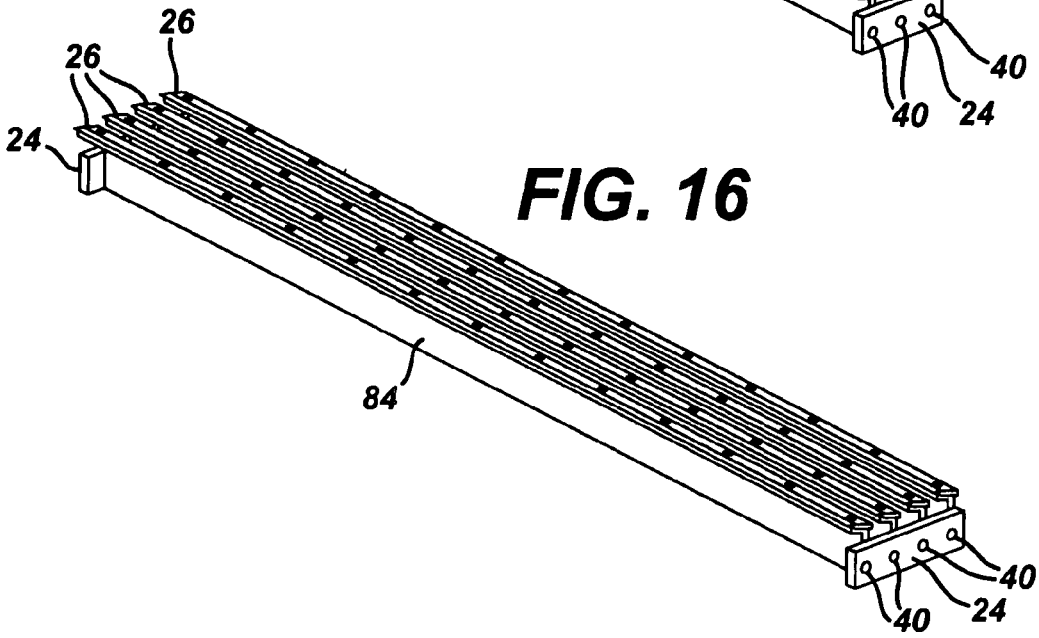

There can be any number of blades, (e.g., 2, 3, 4, 5, 6, 7, etc). Two-, three- and four-blade subassemblies 80, 82, 84, respectively, are shown in FIGS. 14-16, respectively. Also, the cartridge and handle may be integral parts such as a disposable razor.

As discussed above in the Summary section, the recess can be open to the top, with the integral blade unit being lowed into the recess and held in place by clips or by snap-fitting, or alternatively the recess can open to the bottom, with the integral blade unit being raised into the recess.

LISTING OF REFERENCE NUMERALS shaving razor 10
plastic housing 12
integrated blade subassembly 13
blades 14
cap 16
handle 18
connecting piece 19
elastomeric guard 20
recess 21
fins 22
clips 23
side plates 24
cutting member 26
cutting edge 28
elongated support 30
spot welds 32
short upper portion 34
longer base portion 36
longitudinal ends 38
one-piece complex cutting member 39
spot welds 40
one-piece simple cutting member 41
fixture 42
base member 44
slots 46
angled surfaces 48
alignment block 50
corners 52
alternative blade subassembly 60
last blade 62
offset extensions 64
longitudinal ends 66
prior blade portions 68
welds 70
alternative blade subassembly 76
angled side plates 78
Two-blade subassembly 80
Three-blade subassembly 82
Four-blade subassembly 84

What is claimed is:

1. A subassembly for a shaving razor comprising:

a first elongated metal blade having a vertical base portion and an angular upper portion extending at an obtuse angle relative to the vertical base portion, a first cutting member mounted to the angular upper portion, the first cutting member having a first cutting edge defining a first shaving surface, the vertical base portion of the first elongated metal blade having a first and second longitudinal end;

a second elongated metal blade having a second vertical base portion and a second angular upper portion extending at an obtuse angle relative to the second vertical base portion, a second cutting member mounted to the second angular upper portion, the second cutting member having a second cutting edge defining a second shaving surface, the vertical base portion of the second elongated metal blade having a first and second longitudinal end;

a first metal plate and a second metal plate, said first longitudinal ends being connected by a first set of weld connections to said first metal plate, and said second longitudinal ends being connected by a second set of weld connections to said second metal plate; wherein said blades are secured only at said first and second longitudinal ends of the vertical base portions.

2. The subassembly of claim 1 wherein said first and second longitudinal ends are bent and are transverse to said cutting edges.

3. The subassembly of claim 1 wherein said first and second plates have a stainless steel base and an aluminum cladding thereover.

4. The subassembly of claim 1 wherein all said cutting edges are in a common plane.

5. A subassembly for a shaving razor comprising:

a first elongated support having an angular upper portion joined to a first elongated cutting member having a first cutting edge, and a vertical base portion extending at an obtuse angle relative to the angular upper portion, the vertical base portion having a first longitudinal end and second longitudinal end;

a second elongated support having a second angular upper portion joined to a second elongated cutting member having a second cutting edge, and a second vertical base portion extending at an obtuse angle relative to the second angular upper portion the second vertical base portion having a first longitudinal end and second longitudinal end;

a first metal plate securing said first longitudinal ends together;

a second metal plate securing said second longitudinal ends together; and said elongated support members being secured only at said first and second longitudinal ends of the vertical base portions.

6. The subassembly of claim 5 wherein the angular upper portions are shorter than the vertical base portions.

7. The subassembly of claim 5 wherein the elongated cutting members are of one piece construction that are integral with the elongated supports.

8. The subassembly of claim 5 wherein the first elongated support is welded to the first and second metal plates and the second elongated support is welded to the first and second metal plates.

9. The subassembly of claim 5 wherein the first and second plates are corrosion resistant.

10. The subassembly of claim 9 wherein the first and second plates have a stainless steel base and an aluminum cladding thereover.

11. The subassembly of claim 5 wherein the first metal plate is secured to the first longitudinal ends with one or more weld connections and the second metal plate is secured to the second longitudinal ends with one or more weld connections.

12. The subassembly of claim 11 wherein the weld connections are spot welds.

13. The subassembly of claim 5 further comprising a third elongated support having a third angular upper portion joined to a third elongated cutting member having a first cutting edge, and a third vertical base portion extending at an obtuse angle relative to the third angular upper portion, the third elongated support having a first longitudinal end and second longitudinal end.

14. The subassembly of claim 13 further comprising a fourth elongated support having a fourth angular upper portion joined to a fourth elongated cutting member having a fourth cutting edge, and a fourth vertical base portion extending at an obtuse angle relative to the fourth angular upper portion, the fourth elongated support having a first longitudinal end and second longitudinal end.

15. The subassembly of claim 14 further comprising a fifth elongated support having a fifth angular upper portion joined to a fifth elongated cutting member having a fifth cutting edge, and a fifth vertical base portion extending at an obtuse angle relative to the fifth angular upper portion the fifth elongated support having a first longitudinal end and second longitudinal end.

16. A shaving razor comprising:

a sub assembly including a first elongated metal blade having a vertical base portion and an angular upper portion extending at an obtuse angle relative to the vertical base portion, a first cutting member mounted to the angular upper section, the first cutting member having a first cutting edge defining a first shaving surface, the vertical base portion having a first and second longitudinal end;

a second elongated metal blade having a second vertical base portion and a second angular upper portion extending at an obtuse angle relative to the second vertical base portion, a second cutting member mounted to the second angular upper section, the second cutting member having a second cutting edge defining a second shaving surface, the second vertical base portion having a first and second longitudinal end; and a first metal plate and a second metal plate, said first longitudinal ends being connected by a first set of weld connections to said first metal plate, said second longitudinal ends being connected by a second set of weld connections to said second metal plate, wherein said blades are secured only at said first and second longitudinal ends of the vertical base portions; and a housing having a recess in which said subassembly is secured.

* * * * *